US005340179A

United States Patent [19]

Rubin

[11] Patent Number: 5,340,179

[45] Date of Patent: Aug. 23, 1994

[54] BALL RETRIEVER HAVING A COUNTER

[76] Inventor: Robert M. Rubin, 1150 W. Prince Rd., No. 2C, Tucson, Ariz. 85705

[21] Appl. No.: 159,790

[22] Filed: Nov. 29, 1993

[51] Int. Cl.[5] ..... A63B 47/02

[52] U.S. Cl. ..... 294/19.2

[58] Field of Search ..... 294/19.2; 56/328.1, 56/332; 206/315.9, 459.1; 221/2, 7, 8, 307, 310; 222/23; 235/98 R, 98 B; 273/32 D, 32 F, 162 A, 162 E, 162 F; 377/5, 6, 15, 82

[56] References Cited

U.S. PATENT DOCUMENTS 1,937,828 12/1933 MacDonald ..... 294/79.2
2,203,170 6/1940 MacDonald ..... 294/19.2
4,063,769 12/1977 Zimmer ..... 294/19.2
4,194,779 3/1980 Ouhashi ..... 294/19.2

*Primary Examiner*—Johnny D. Cherry
*Attorney, Agent, or Firm*—Schmeiser, Morelle & Watts

[57] ABSTRACT

The invention is a ball retrieval device that includes a counter readable when the device is in its normally upstanding orientation. One embodiment of the device includes a mechanical counter that is actuable by the user. A second embodiment of the device employs an electrically-powered counter that is automatically actuated whenever a ball enters the bottom end of the device's ball receiving tube.

15 Claims, 2 Drawing Sheets

BALL RETRIEVER HAVING A COUNTER

FIELD OF THE INVENTION

The invention is in the field of golf accessories. More particularly, the invention is a ball retriever designed to facilitate the collecting of golf balls. The retriever includes a counter that enables a user to record the number of balls collected.

BACKGROUND OF THE INVENTION

During a typical practice session, a golfer will usually hit a large number of golf balls from one area to another. This leads to the golfer having to retrieve or "shag" all of the hit balls. This "shagging" operation will usually require that the golfer bend over to retrieve each ball. This repetitive movement is inconvenient and can overly stress the golfer's back muscles.

A number of products have been invented to facilitate the ball retrieval process. Typical of these products are the MacDonald retrievers shown in his U.S. Pat. Nos. 1,937,828 and 2,203,170. Each of these retrievers includes a tubular receiver that has a check-valve structure located at its bottom end. The check-valve structure allows only one-way travel of the ball into the bottom of the tube. By using retrievers of this type, a golfer is not required to bend over to retrieve the ball. The golfer merely pushes the bottom end of the tubular receiver over the ball and the ball is then forced into the retriever where it is stored until it is removed from the top portion of the unit.

While prior art golf ball retrievers have significantly eased shagging of golf balls, a golfer still must keep track of the number of balls that are collected. For example, if a golfer hits twenty-five balls, he or she must mentally keep track of the number of balls collected to ensure that none of the balls has been lost or gone uncollected. While MacDonald shows numerical indicia on the side of the retriever described in his '828 patent, these indicia are not readily visible when the retriever is in use. In addition, the indicia system he uses cannot be readily applied to the more common types of retrievers typified by the retriever shown in his '170 patent.

Therefore, prior art ball retrievers do not conveniently provide a running count of the balls collected using the retriever. In addition, many golfers may wish to keep track of the total number of balls hit during a practice session in which the retriever has been filled and emptied a plurality of times. There are no prior art devices that can record and provide this information.

SUMMARY OF THE INVENTION

The invention is a ball retriever that includes an upstanding collection tube that has a one-way valve structure located proximate its bottom end. The top of the tube is located within and empties into a large, cylindrical collection bag. The collection bag has a normally closed outlet port and is sized to receive approximately eighty golf balls. Located at the top of the retriever is a handle structure that enables a user to manipulate the retriever in a convenient manner.

The invention further includes a counter mechanism located proximate the handle. The counter includes an upwardly facing display that is easily readable by the user when the retriever is in its normal, upstanding orientation. The counter can be either an automatically or manually actuated unit. In the automatically-actuated unit, the counter automatically counts each ball that enters the retriever. In the manually-actuated unit, the counter is actuated by the user each time a ball is entered into the retriever's receiving tube.

In the preferred embodiment of a retriever having an automatic counter, the counter unit is electrically powered by a replaceable battery. The unit includes a remote sensor that is a part of the check-valve structure located at the bottom of the receiving tube. Whenever a ball enters the tube, the sensor is actuated and causes the counter to increase the number displayed accordingly. The counter's display preferably has two or three digits and is designed to be readable from a point above the unit.

In a retriever having a manually-actuated counter, the counter is preferably directly mounted on the handle and includes an actuator reachable by the thumb of the user's hand that is grasping the handle. This allows a user to actuate the counter each time a ball is collected into the retriever. The counter preferably has a two or three digit display that faces upwards and is thereby easily readable by a user whenever the retriever is in use.

DETAILED DESCRIPTION OF THE DRAWINGS

Figure 1:
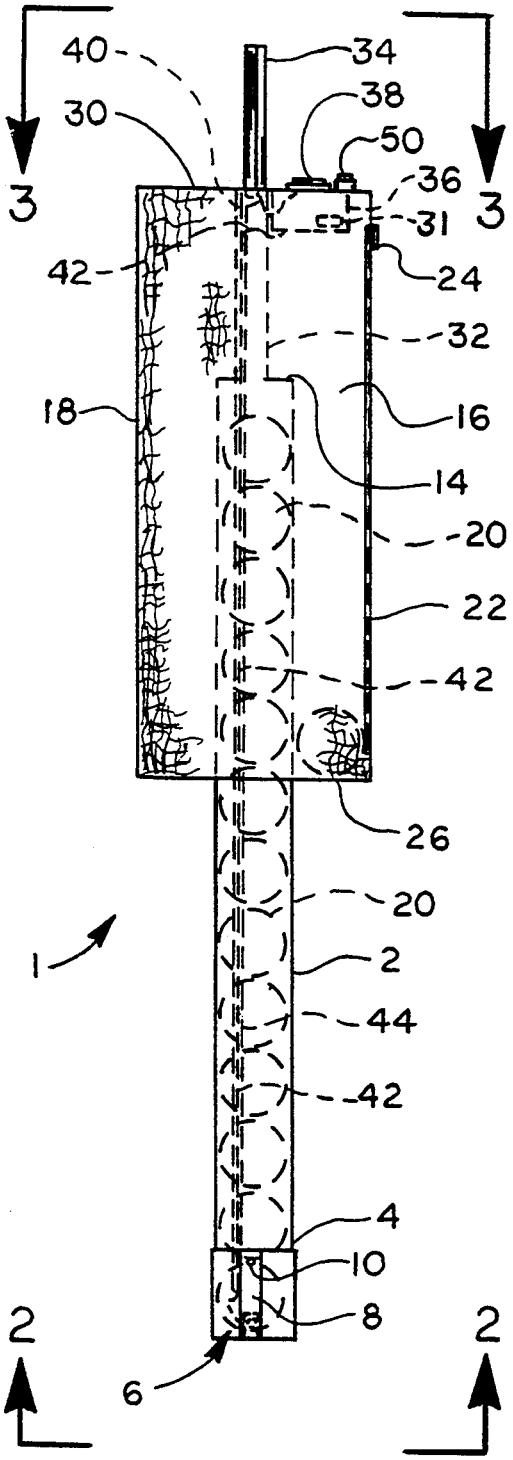
FIG. 1 is a side view of a first embodiment of a ball retriever in accordance with the invention.

Referring now to the drawings in greater detail, wherein like reference characters refer to like parts throughout the several figures, there is shown by the numeral 1 a first embodiment of a ball retriever in accordance with the invention.

The retriever comprises an elongated, hollow ball receiving tube 2 that is open at both ends and is normally oriented in an upstanding position. The tube is preferably made of a light-weight metal material and measures approximately two feet in length. For usage as a golf ball retrieval device, the tube will have an interior diameter of approximately two inches.

Located proximate the bottom end 4 of the tube is a ball checking assembly 6. The assembly allows a ball to enter the bottom of the tube but does not normally allow a ball to leave the tube. As such, the assembly is similar to a check valve and allows only one-way travel of material through the end of the tube.

Figure 2:
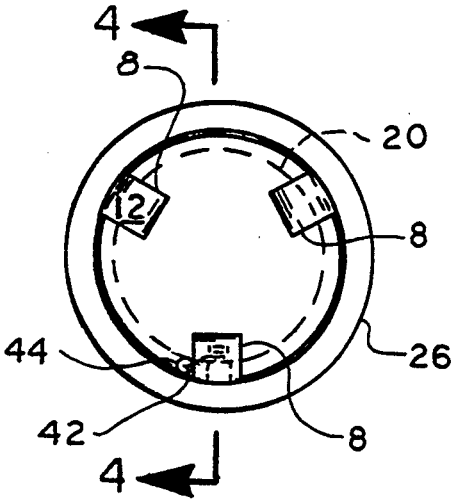
FIG. 2 is a bottom view of the retriever shown in FIG. 1.
Figure 4:
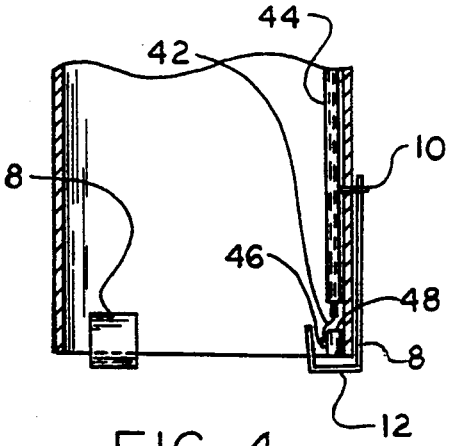
FIG. 4 is a cross-sectional side view of the bottom portion of the retriever shown in FIG. 1.

As can be seen in FIG. 1, 2 and 4, the ball checking assembly 6 includes three flexible fingers 8 that are movably anchored to the side of tube 2 by fasteners 10. Each finger is substantially 'L'-shaped with its bottom portion 12 extending into the interior of the tube. The fingers are preferably made from a resilient metal material wherein the finger's bottom portion can be temporarily moved in an outward direction by a ball entering the tube.

The top end 14 of the tube 2 extends into a large, cylindrical compartment 16 that is enclosed by a flexible fabric cover 18. The compartment and tube are in mutual communication wherein collected balls 20 (shown in phantom) can pass in an unrestricted fashion from the interior of the tube into the interior of the compartment via the tube's top opening. The compartment is approximately six inches in diameter and has a height of approximately fifteen inches. When filled, the retriever can store up to approximately seven dozen golf balls.

The cover 18 has a normally-closed side-located opening 22. The opening is releasably secured in a closed condition using a zipper-type fastener 24.

The compartment 16 preferably has a metal, plate-like bottom member 26 and a similar top member 30. The top member is connected to the tube 2 by a rigid support 32 that is preferably manufactured from a metal material. Located on a top surface of the top member 30 is a 'C'-shaped handle 34. By virtue of the support 32, the handle is effectively rigidly secured to the tube and thereby allows a user to comfortably manipulate and position the tube by appropriate movement of the handle.

In FIGS. 1–4, an automatic counter assembly is shown in combination with the retriever as already described. The counter includes an electrically-powered calculating unit 36 that is secured to the underside of member 30. The unit is powered by an internal removable battery 31 and is essentially a standard, well known type of electrical counter as found in calculators and other devices in which a simple calculating device is required. The unit has an LED-type display 38 that is located on the top surface of member 30 and is thereby readable from a point above the display. The counter unit includes a ground wire 40 that extends from the unit to the top of the metal support 32 which is in contact with the metal tube 2.

As can be seen in FIG. 1, a long insulated wire 42 is connected to unit 36 and extends down therefrom and runs within a protective conduit 44 along the interior surface of the tube. The wire terminates at and is connected to a contact 46 (note FIG. 4). The contact is secured to the tube using a non-conductive insulating block 48. It should be noted that the contact 46 is located adjacent one of the metal fingers 8.

When a ball enters the bottom of the ball receiving tube 2, it causes the fingers 8 to move outwardly whereby the finger adjacent the contact 46 touches the contact. This action "grounds" wire 42 to the tube since the metal finger 8 is in contact with the tube via its associated fastener 10. The grounding of wire 42 to the tube 2 completes the electrical circuit and causes the counter unit 36 to increase by one the number shown in its display 38.

Figure 3:
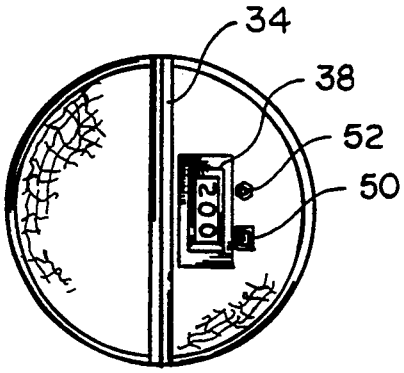
FIG. 3 is a top view of the retriever shown in FIG. 1.

As can be seen in FIG. 3, there are two buttons 50 and 52 located adjacent the counter's display 38. Button 50 is connected to the counter unit 36 and turns the unit on or off. Button 52 is also connected to the counter unit 36 and functions to reset or "zero" the display.

Figure 5:
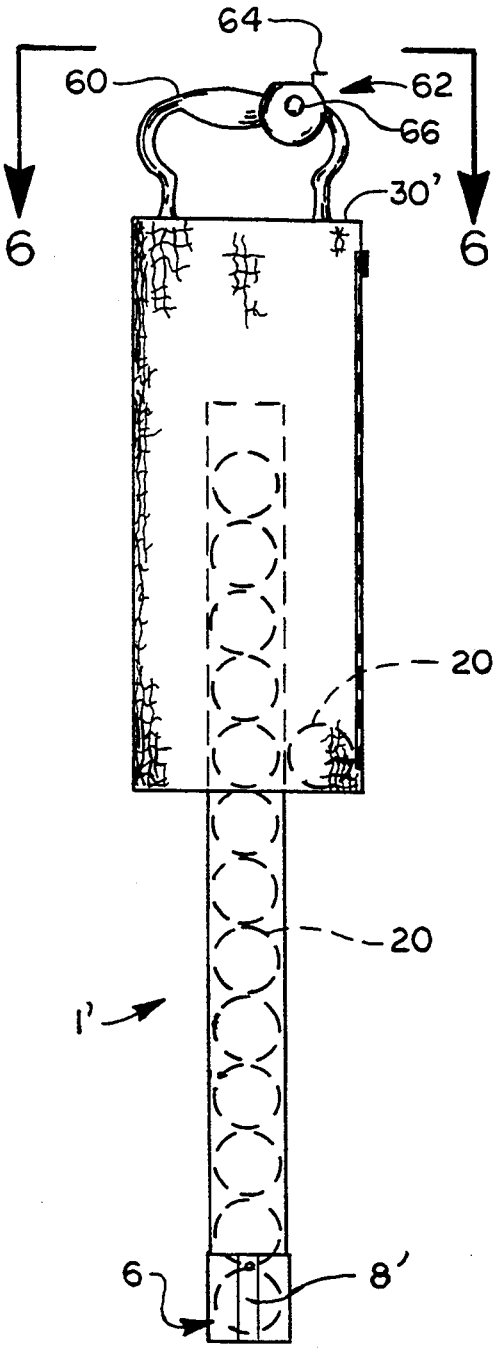
FIG. 5 is a side view of a second embodiment of a ball retriever in accordance with the invention.
Figure 6:
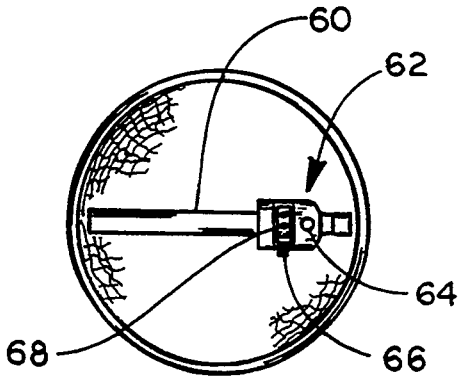
FIG. 6 is a top view of the retriever shown in FIG. 5.

FIGS. 5 and 6 show a second embodiment of a ball retriever 1'. In this embodiment, a manually-actuated counter is employed.

The retriever 1' is basically identical to the retriever 1 previously described except for the details attributable to the particular counter. The retriever 1' includes the same ball checking structure 8' as previously described in which three resilient fingers 8' are used to allow one-way passage of a ball into the bottom of the tube. The ball checking structure is basically identical to the checking structure described by MacDonald in his '170 reference.

Located on the top surface of the plate-shaped member 30' that forms the top of the ball storage compartment is a 'C'-shaped handle 60. This handle is similar to handle 34 except that it has a built-in manually-actuated counter 62. The counter is a simple, mechanical unit of well known type similar to popular hand-held counters and which has internal gearing that is actuated by a top-located actuator button 64. The counter also includes a side-located reset knob 66. Located at the top of the counter is a display 68 that can preferably show a count of up to either 99 or 999. The display faces upwards whereby it is easily readable by a user holding the unit by the handle 60.

In the retriever shown in FIGS. 5 and 6, whenever a ball is picked up, the user manually presses the counter's actuator button 64 once to increase the number shown in the display 68 by one unit. The user can reset or "zero" the counter at any time by properly rotating the reset knob 66. It should be noted that by locating the counter wherein the actuator button is located within reach of one of the user's fingers that are grasping the handle, one-handed operation of the retriever is possible even when the counter is being employed.

The ball retriever as described herein allows a user to keep track of the number of balls collected using the device. This information allows the user to know how many balls are stored in the device prior to its being emptied. This information also allows a user to maintain a running tally of the balls collected during the retrieval process. The counter can be reset after each use or it can be used to maintain a running tally of the collected balls for an entire practice session in which the retriever has been filled and emptied a plurality of times.

The embodiments disclosed herein have been discussed for the purpose of familiarizing the reader with the novel aspects of the invention. Although preferred embodiments of the invention have been shown and described, many changes, modifications and substitutions may be made by one having ordinary skill in the art without necessarily departing from the spirit and scope of the invention as described in the following claims.

I claim:

1. A ball retrieval device comprising:

an upstanding ball receiving tube, said tube having a bottom end, a top end, an inlet proximate said bottom end and an outlet proximate said top end;

a ball checking means located proximate the inlet of said ball receiving tube, said checking means functioning to allow one-way passage of balls into said tube;

a ball receiving compartment located proximate the top end of said tube, said compartment having an interior space that is in communication with the tube's outlet;

a handle located at least partially above said compartment and wherein said handle is operatively connected to said tube; and a numerical counter unit mounted to said device, said counter unit being capable of counting any balls collected using the retrieval device and wherein said counter unit has a multi-digit display proximate said handle and wherein said display is clearly visible from a location above said handle.

2. The device of claim 1 further comprising a normally closed ball discharge means operatively connected to the ball receiving compartment.

3. The device of claim 1 wherein said counter unit includes actuation means that can be triggered when a ball enters the inlet of the tube.

4. The device of claim 3 wherein the actuation means is manually-actuable by a user and is designed to be actuated by a user whenever a ball enters the inlet of the tube.

5. The device of claim 4 wherein the actuation means of the counter unit is in the form of a button located proximate the handle wherein a user can press said button using a finger of a hand that is grasping the handle.

6. The device of claim 5 wherein the counter unit forms a part of the handle.

7. The device of claim 5 wherein the counter unit has a display capable of showing at least two side-by-side digits and wherein the counter unit further includes reset means that allows a user to reset the display to zero.

8. The device of claim 3 wherein the counter unit is automatically actuated by a ball sensing means whenever a ball enters the tube's inlet.

9. The device of claim 8 wherein the ball sensing means is located proximate the bottom end of the tube.

10. The device of claim 9 wherein the ball sensing means is actuated by a portion of the ball checking means.

11. The device of claim 10 wherein the ball checking means includes a plurality of movable finger means and wherein one of said finger means can contact a portion of said ball sensing means.

12. The device of claim 8 wherein the counter unit is electrically powered by a battery.

13. The device of claim 12 wherein the ball sensing means includes an electrical contact that is actuated whenever a ball enters the tube.

14. The device of claim 13 wherein the ball sensing means is located proximate the inlet of said tube and wherein a wire extends at least partially along the tube and connects the electrical contact of the ball sensing means to the counter unit.

15. The device of claim 14 wherein the counter unit has a display capable of displaying at least two digits in a side-by-side manner and wherein said counter unit includes a reset means that allows the display to be reset to show a zero reading.

PAGE 14

* * * * *